United States Patent [19]

Smith et al.

[11] 3,970,887

[45] July 20, 1976

[54] MICRO-STRUCTURE FIELD EMISSION ELECTRON SOURCE

[75] Inventors: Donald O. Smith; John S. Judge, both of Lexington; Michael Trongello, Medford, all of Mass.; Patrick R. Thornton, Saratoga, Calif.

[73] Assignee: Micro-Bit Corporation, Lexington, Mass.

[22] Filed: June 19, 1974

[21] Appl. No.: 480,962

[52] U.S. Cl. ..... 313/309; 313/336; 313/351; 313/366; 357/4; 29/25.11

[51] Int. Cl.[2] ..... H01J 1/02

[58] Field of Search ..... 313/336, 309, 366, 367, 313/306, 351, 95; 357/4, 18; 29/25.11

[56] References Cited

UNITED STATES PATENTS

| | | | |
|---|---|---|---|
| 2,959,704 | 11/1960 | Snell, Jr. et al. | 313/309 |
| 3,419,746 | 12/1968 | Crowell et al. | 313/366 |
| 3,466,485 | 9/1969 | Arthur, Jr. et al. | 313/309 X |
| 3,665,241 | 5/1972 | Spindt et al. | 313/336 |
| 3,748,523 | 7/1973 | Collings et al. | 313/367 X |
| 3,805,126 | 4/1974 | Frobenius | 313/367 |
| 3,814,968 | 6/1974 | Nathanson et al. | 313/109 X |
| 3,852,595 | 12/1974 | Aberth | 313/309 |

*Primary Examiner*—Saxfield Chatmon, Jr.
*Attorney, Agent, or Firm*—Charles W. Helzer

[57] ABSTRACT

A new and improved microminiature field emission electron source and method of manufacturing is described using a single crystal semiconductor substrate. The substrate is processed in accordance with known integrated microelectronic circuit techniques to form a plurality of integral, single crystal semiconductor raised field emitter tips at desired field emission cathode sites on the surface of the substrate in a manner such that the field emitter tips are integral with the single crystal semiconductor substrate. An insulating layer and overlying conductive layer may be formed in the order named over the semiconductor substrate and provided with openings at the field emission site locations to form micro-anode structures for each field emitter tip. By initially appropriately doping the semiconductor substrate to provide opposite conductivity-type regions at each of the field emission sites, and appropriately forming the conductive layer, electrical isolation between the several field emission sites can be obtained.

18 Claims, 26 Drawing Figures

FIG. 1G
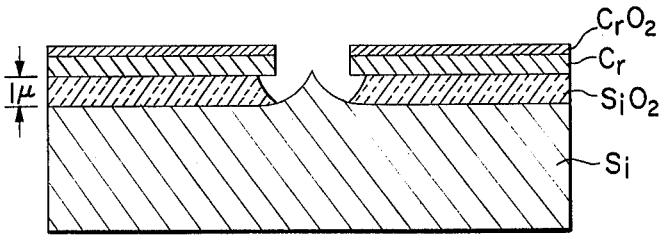
FIG. 1H
(ALTERNATIVE)
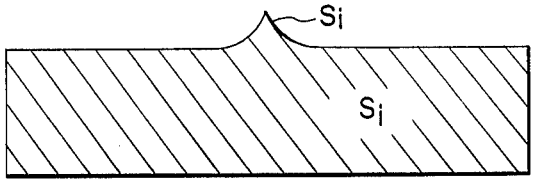
FIG. 6
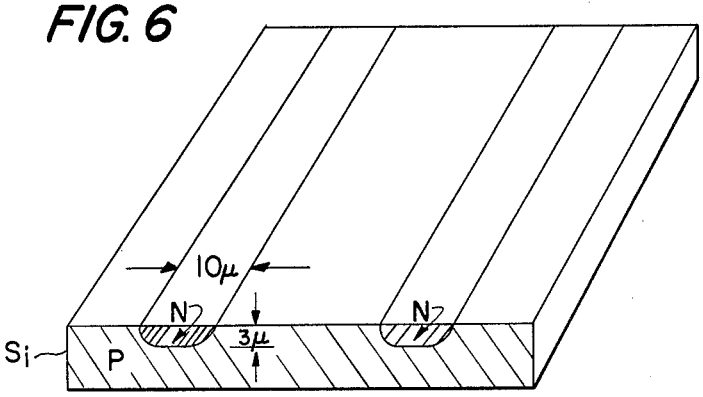
FIG. 7
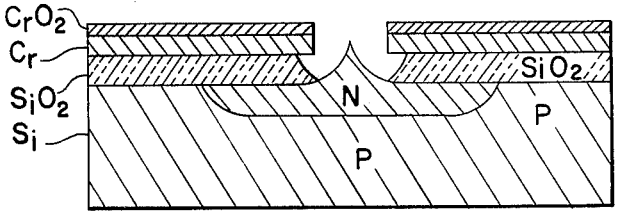
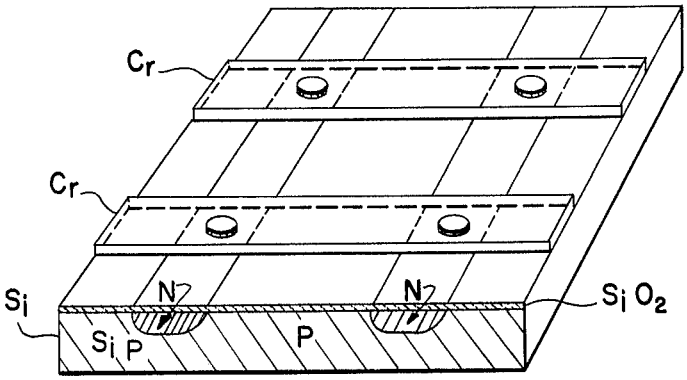
FIG. 8

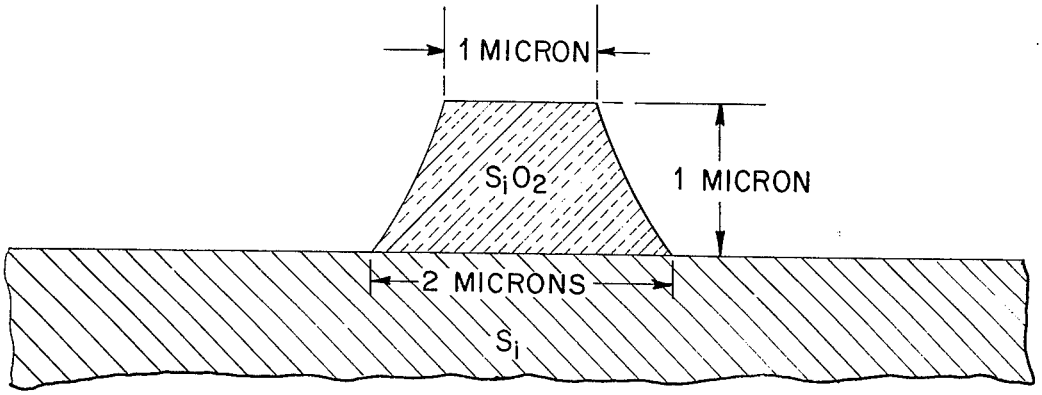
FIG. 4A
FIG. 4B
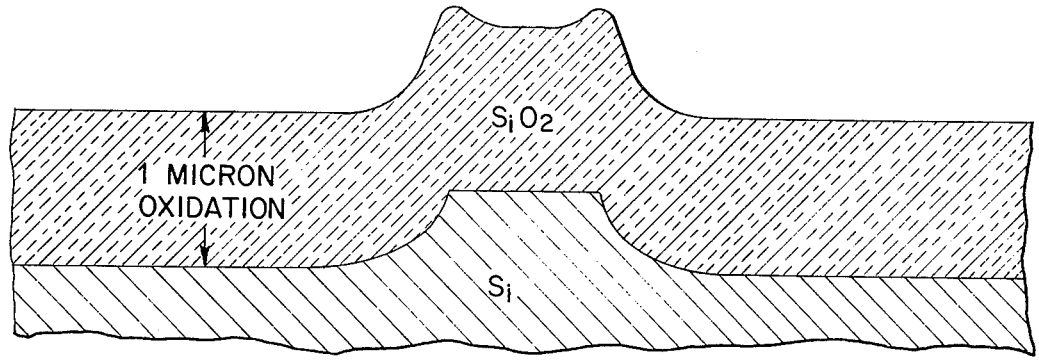
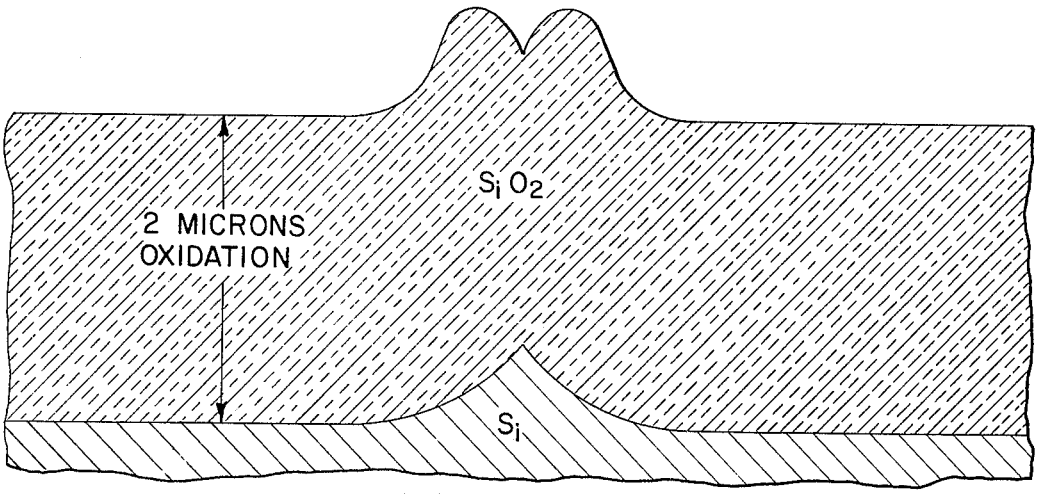
FIG. 4C

MICRO-STRUCTURE FIELD EMISSION ELECTRON SOURCE

BACKGROUND OF INVENTION

1. Field of Invention

This invention relates to new and improved microminiature structures for use as a field emitter electron sources and to new methods of manufacturing field emitter electron sources using semiconductor microminiature integrated circuit manufacturing techniques.

2. Background of Problem

It has long been known that electron current densities which can be obtained from field-emission sources is much greater than those that can be obtained from thermal sources. For example, field emission electron sources have been operated at current densitites as high as $10^8$ amperes per square centimer ($10^8$amps/cm$^2$), while the maximum current density normally obtainable from a thermal electron source is less than $10^2$amps/cm$^2$. Additionally, field emitter electron sources intrinsically are smaller than thermal electron sources, and in general are less than one micron in diameter. In contrast, practical thermal electron sources cannot be made smaller than about 100 microns. Because there are many applications in which a small electron source size is important, this characteristic feature of the field emitter electron source makes it desirable for use in a number of equipments. For example, in high resolution scanning electron microscopy and in high density electron beam recording for information storage and retrieval, the field emitter electron source, because of its intrinsic small size, would be desirable.

In spite of the above-listed desirable advantages inherent with field emission electron sources, there has been no widespread practical use of such sources due principally to the limited lifetime which conventional field emission sources possess. It has been established that the primary cause of the short operating life characteristic of known field emission sources is due to the erosion of the emitting tip by ion bombardment of the tip by ions which are generated by the emitted electrons colliding with residual gas atoms normally surrounding the emitting tip.

There are a number of prior art microstructure field emission electron sources which have been developed in an effort to overcome this problem and are available to the industry. One such prior art microstructure field emission cathode is described in an article entitled, "A Thin-Film Field-Emission Cathode," by C. A. Spindt appearing in the Journal of Applied Physics, 39(7), 3504-05, June, 1968. Still another microstructure field emission cathode source is described in U.S. Pat. No. 3,453,478 — Issued July 1, 1969 — K. R. Shoulders, et al., entitled, "Needle-Type Electron Source," International Class HO-lJ, U.S. Class 313-309. The Journal of Applied Physics article describes a method for fabricating a microstructure field emission electron source which results in the formation of a single emitter tip at each one of a plurality of sites by the codeposition of a metal such as molybdenum at both normal and grazing incidence while at the same time rotating the substrate. This known technique is more complicated, expensive, and less likely to produce well-oriented single crystal tip emitters in a reliable and reproducible manner than is the present invention. The structure and techniques described in U.S. Pat. No. 3,453,478, results in the production of a multiplicity of emitter points at each field emission cathode site and is disadvantageous since focusing to a single fine spot with the multiplicity of emitter tips is difficult. To overcome these difficulties, the present invention was devised.

SUMMARY OF INVENTION

It is, therefore, a primary object of the present invention to provide a new and improved microminiature field emission cathode structure and electron source having well oriented single crystal emitter tips and which minimizes the effect of erosion of the emitting tip and, hence, leads to a longer operating lifetime.

Another object of the invention is to provide new and improved methods for manufacturing microminiature field emission cathode structures utilizing known microminiature integrated circuit manufacturing techniques.

A further object of the invention is to provide new and improved microminiature electron sources having integrally formed single crystal semiconductor microstructure field emission cathodes and integrally packaged accellerating micro-anodes.

A still further feature of the invention is to provide new methods of manufacturing the new and improved microminiature electron sources having the characteristics listed above.

Still another object of the invention is to provide new microminiature field emission sources which can be fabricated in the form of an array wherein only one or several of the electron field emission sites selectively can be activated and wherein one field emission site can be electrically isolated from other sites.

In practicing the invention a new field emission cathode microstructure and method of manufacturing the same is provided using an underlying single crystal, semiconductor substrate. The semiconductor substrate may be either P or N-type and is selectively masked on one of its surfaces where it is desired to form field emission cathode sites. The masking is done in a manner such that the masked areas define islands on the surface of the underlying semiconductor substrate. Thereafter, selective sidewise removal of the underlying peripheral surrounding regions of the semiconductor substrate beneath the edges of the masked island areas results in the production of a centrally disposed, raised, single crystal semiconductor field emitter tip in the region immediately under each masked island area defining a field emission cathode site. It is preferred that removal of the underlying peripheral surrounding regions of the semiconductor substrate be closely controlled by oxidation of the surface of the semiconductor substrate surrounding the masked island areas with the oxidation phase being conducted sufficiently long to produce sideways growth of the resulting oxide layer beneath the peripheral edges of the masked areas to an extent required to leave only a non-oxidized tip of underlying, single crystal semiconductor substrate beneath the island mask. Thereafter, the oxide layer is differentially etched away at least in the regions immediately surrounding the masked island areas to result in the production of a centrally disposed, raised, single crystal semiconductor field emitter tip integral with the underlying single crystal semiconductor substrate at each desired field emission cathode site.

A new and improved composite microminiature field emission electron source including a built-in accelerating micro-anode structure is provided by the method steps comprising a first oxidation of the surface of the single crystal semiconductor substrate to form a first oxide layer, deposition of a photoresist layer over the first oxide layer and exposure and development of selected island areas on the surface of the photoresist layer to form raised, masked island areas defining desired field emission cathode sites. The undeveloped photoresist layer and the underlying first oxide layer beneath the undeveloped photoresist layer is then removed. A further or second oxidation of the resulting structure is then carried out sufficiently to produce sideways growth of a resulting second oxide layer beneath the peripheral edges of the masked island areas to the extent required to define a non-oxidized tip of underlying semiconductor substrate beneath each island area. Following this step, a conductive metal layer is deposited normal to or at oblique incidence to the surface of the second oxide layer and results in a structure having a raised island oxide layer at each field emission cathode site. The conductive metal layer may then be subjected to oxidation to improve its resistance to chemical attack. Thereafter, the exposed sides of the raised island oxide layers at each field-emission cathode site (the sides and/or top of which are not covered by the oxidized normally or obliquely applied metal layer) are etched away to result in a composite field emission electron source having integrally formed, centrally oriented, single crystal field emitter tips and micro-anode structures defined by the conductive metal layer surrounding each field emission cathode site. The distance between the emitter tips and microanode structures is controlled by the method of fabrication and is discussed later.

In a preferred embodiment of the invention, the immediate region of the semiconductor substrate surrounding and including the raised cathode emitter tips is appropriately doped to form an opposite conductivity-type semiconductor region from that of the remainder of the underlying single crystal semiconductor substrate whereby the plurality of field emission cathode sites can be electrically isolated one site from the other. The opposite-type conductivity regions in which the cathode emitter tips are located may comprise a plurality of parallel elongated strips of opposite-type conductivity regions and the overlying conductive layer may be comprised of a pluralilty of parallel, elongated conductive metal layer strips extending transversely to and across the opposite-type conductivity strip regions with the intersections defining a plurality of regularly arrayed cathode emission sites in the manner of a cross bar connector. By the application of appropriate polarity switching potentials to a selected one of the elongated opposite-type conductivity region strips and to a selected one of the transversely extending, conductive layer strips, selective actuation of a desired one of the field emitter sites can be achieved together with electrical isolation from the remaining field emitter sites.

BRIEF DESCRIPTION OF THE DRAWINGS

These and other objects, features and many of the attendant advantages of this invention will be appreciated more readily as the same becomes better understood by reference to the following detailed description, when considered in connection with the accompanying drawings, wherein like parts in each of the several figures are identified by the same reference character, and wherein:

FIGS. 1A–1H depict the several of the basic steps employed in manufacturing new and improved, composite microminiature electron sources according to the invention;

FIGS. 4A–4C illustrate an alternative processing method for producing field emission cathode sites according to the invention;

FIG. 6 is a perspective view of a pretreated single crystal semiconductor substrate having strips of opposite-type conductivity regions formed therein and which can be employed in practicing a preferred form of the invention;

FIG. 7 is a cross-sectional view of a portion of a new and improved microminiature electron source constructed in accordance with the invention and employing the pretreated semiconductor substrate shown in FIG. 6; and FIG. 8 is a top perspective view of a completed microminiature electron source constructed according to FIGS. 6 and 7 of the drawings and with which selective actuation of a desired one of an array of field emission sites can be obtained.

DETAILED DESCRIPTION

The invention can best be described with reference to FIGS. 1A-1H of the drawings which depict the initial, intermediate and final structures produced by a series of manufacturing processing steps according to the invention. A generally planar, semiconductor substrate which may comprise a wafer of single crystal silicon shown at Si preferably is employed in fabricating the improved microminiature electron field emission sources. The wafer of single crystal silicon (Si) is first cleaned in accordance with known standard techniques. One of the planar surfaces of the silicon wafer is then oxidized to a depth of about one micron to produce an oxide layer of $SiO_2$. Any conventional, known oxidation process may be employed in forming the $SiO_2$ layer such as those which are described in the textbook entitled, Microelectronics, edited by Max Fogiel, published by the Research and Education Association, New York, N.Y., 1969 edition, Copyright 1968. Subsequent to the formation of the $SiO_2$ oxide layer, a thin layer of photoresist (PR) is coated over the $SiO_2$ layer in a known manner to result in the intermediate structure shown in FIG. 1A.

Subsequent to this processing, the treated surface is then exposed through a suitable mask to either light or electron and the photoresist developed to result in a plurality of developed photoresist islands (PR) that preferably are circular with a depth of about one micron and a diameter of the order of two microns. These islands are located at points on the surface of the silicon wafer (Si) where it is desired to form field emission cathode sites. After development of the exposed islands of photoresist, the remaining undeveloped photoresist layer is removed by conventional techniques to result in the intermediate structure shown in FIG. 1B and/or 2A.

At this stage, the oxide layer ($SiO_2$) not protected by developed photoresist island masks (PR) is etched away by any well-known technique such as ion etching in which the surface of the structure is exposed to bombardment by heavy ions. The rate at which the $SiO_2$ layer is removed by ion etching depends strongly on the material being bombarded so that it is required that a differential etching rate be established between the photoresist island layers (PR) and the outside layer ($SiO_2$) such that the exposed $SiO_2$ is removed before the photoresist layer (PR) to result in the structure shown in FIG. 1C. At this point, the remaining developed photoresist island layers (PR) can be removed by any known means.

Figure 1A:
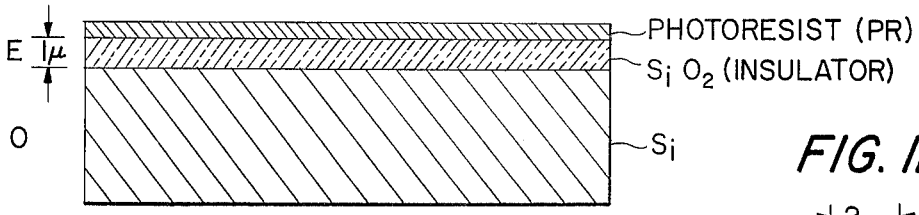
Figure 1B:
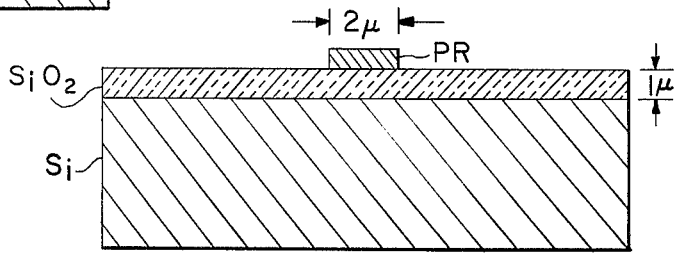
Figure 1C:
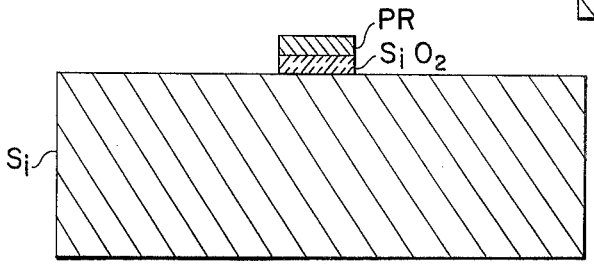
Figure 1D:
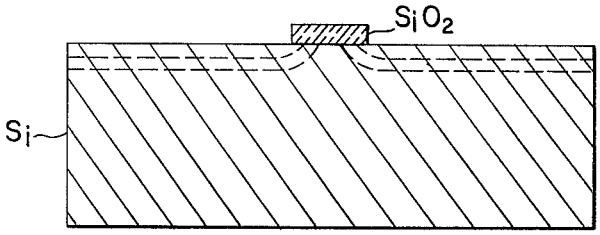

The next step in fabrication is to subject the surface of the silicon wafer containing the $SiO_2$ islands to a second oxidation treatment as indicated in FIG. 1D. In this second oxidation step, the first $SiO_2$ island layers already present on the surface of the silicon wafer (Si) serve as a partial mask to further oxidation of the silicon underneath the islands of $SiO_2$. However, oxidation of the underlying semiconductor silicon wafer also will proceed from the edges of the $SiO_2$ island masks (which preferably are circular) and will grow toward the center from the peripheral edges as depicted by the phantom lines in FIG. 1D. Eventually, the growing Si-$SiO_2$ interface will meet underneath the center of the $SiO_2$ island masks to form a tip of non-oxidized single crystal silicon semiconductor as shown in FIG. 1E whereupon further oxidation is stopped.

At this stage in the processing, there are two possible ways of proceeding further. One procedure is depicted in FIG. 1H wherein the $SiO_2$ layer of the structure shown in FIG. 1E is etched away either by ion etching or otherwise to leave an exposed silicon tip field emitter at each field emission site. The resulting structure could then be used with an externally applied microanode to form a field emission electron gun or otherwise.

Figure 1E:
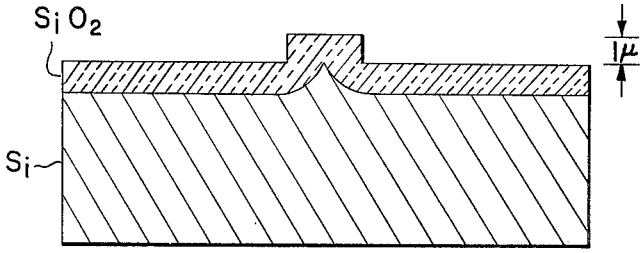
Figure 1F:
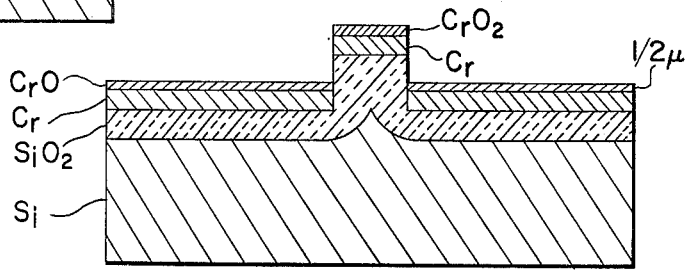

The preferred manner of proceeding from the process stage depicted in FIG. 1E, however, is illustrated in FIG. 1F. By proceeding in the manner depicted in FIGS. 1F and 1G, a micro-anode structure can be provided as an integral part of the field emitter cathode structure thereby resulting in a composite, microstructure field emission electron source having superior operating characteristics. The first step depicted in FIG. 1F is to deposit on the intermediate structure of FIG. 1E a layer of conducting metal such as chromium at normal incidence to the $SiO_2$ layer to a thickness of about one half the height of the projecting $SiO_2$ island masks. In the particular example being described, the resulting $SiO_2$ island masks would project above the surface of the metallized chromium layer about one-half micron (5000 Angstrum units). Because of the normal deposition incidence of the chromium metallizing layer, the $SiO_2$ island masks would be capped with a thin metal layer but the vertically extending sides of the $SiO_2$ islands would be exposed. At this stage, the surface of the chromium metal is oxidized to make it resistant to chemical attack. The resulting structure with a $CrO_2$ protective layer is shown in FIG. 1F.

The final processing step is to subject the surface of the intermediate structure shown in FIG. 1F to a suitable chemical etchant which is differential in its action and will attack only the exposed sides of the $SiO_2$ islands but will have no effect on the underlying silicon semiconductor substrate or the oxidized metal surface. The final structure is illusrated in FIG. 1G wherein it will be seen that each field emitting cathode tip will be provided with a surrounding chromium metallized layer separated from the silicon semiconductor substrate by an insulating layer of $SiO_2$.

Because of the formation techniques described above, it will be assured that the integral field emitting tips of single crystal silicon will be centrally positioned and properly oriented within the surrounding metal layer micro-anode structures. The physical distance or spacing between the field emitting cathode tips and their associated surrounding micro-anode metallized layers can be closely and uniformly controlled by controlling the degree or extent of the second oxidation and final etching steps. This will assure that only a very small open space is provided between the field emitting cathode tips and their surrounding micro-anodes within which ions can be formed and directed back to erode the tips. Because of this small spacing or distance, the high electric fields required for field emission can be obtained with only relatively low voltages being applied between the metallized layer forming the micro-anodes and the silicon semiconductor substrate base. Because only low voltages are required, they can be rapidly and readily switched without difficulty to satisfy the requirements of electron beam information processing systems where it is intended that the improved microminiature field emission electron source be used.

It is believed obvious to one skilled in the art that the manufacturing method described above for making improved microminiature field emission electron sources according to the invention is capable of considerable variation. For example, in place of silicon, it is possible to employ germanium or some other known single crystal semiconductor wafer. In place of the $SiO_2$ oxidation mask which is fabricated by any of a number of known oxidation processing techniques, other materials and other methods could be used to form the insulating masks. One suitable alternative material might be $SiN_2$ applied through a suitable nitriding process step. The $SiN_2$ layer would be particularly effective against oxygen diffusion and, hence, could be employed to make much thinner insulating layers than $SiO_2$. Other variations and modifications will be suggested to those skilled in the microminiature semiconductor circuit manufacturing art.

Figure 2A:
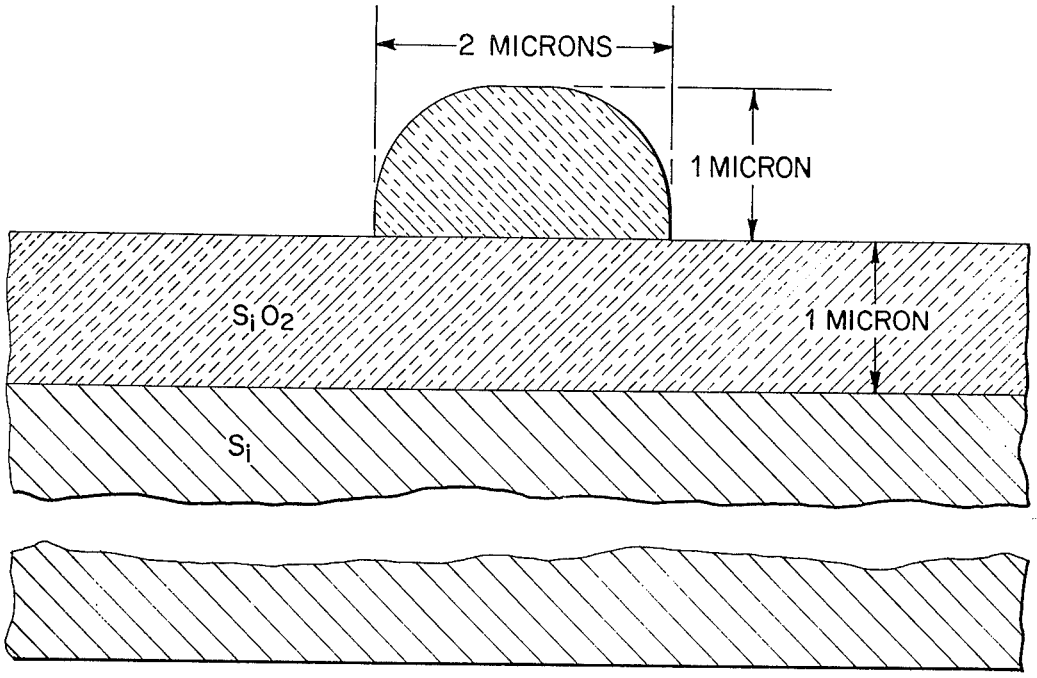
FIGS. 2A–2E illustrate more accurately the resulting intermediary structures resulting from the various processing steps previously described with relation to FIGS. 1A–1H, during actual processing.
Figure 2B:
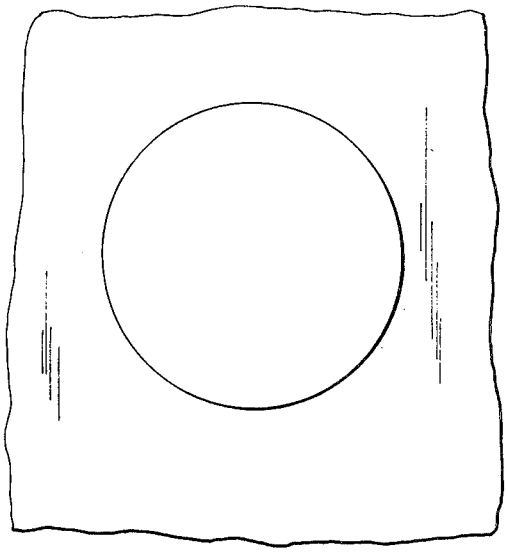
Figure 2C:
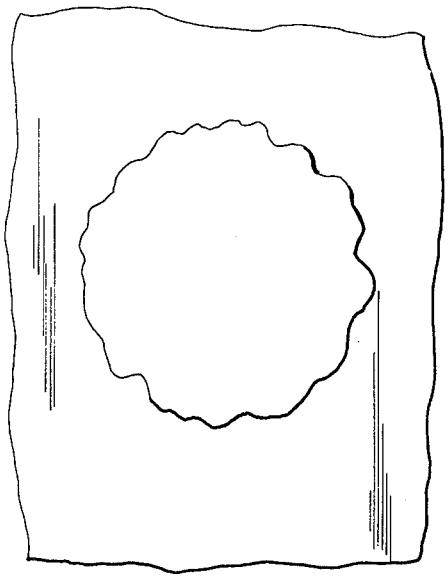

FIGS. 2A–2E more accurately depict the intermediary structure resulting from the above briefly described processing steps. FIG. 2A shows the starting point for developing the oxide mask. This situation may be accomplished by standard means. However, in order to achieve perfectly round photoresist masks (and subsequently perfectly round oxide dots), as shown in FIG. 2B, it is necessary to depart from standard processing and heat the developed resist above its softening point for a period of time. For some commercial resists this temperature is ~ 180°C. If this is not done, a ragged edge is formed as in FIG. 2C, which is deleterious to further processing as will become apparent.

Figure 2D:
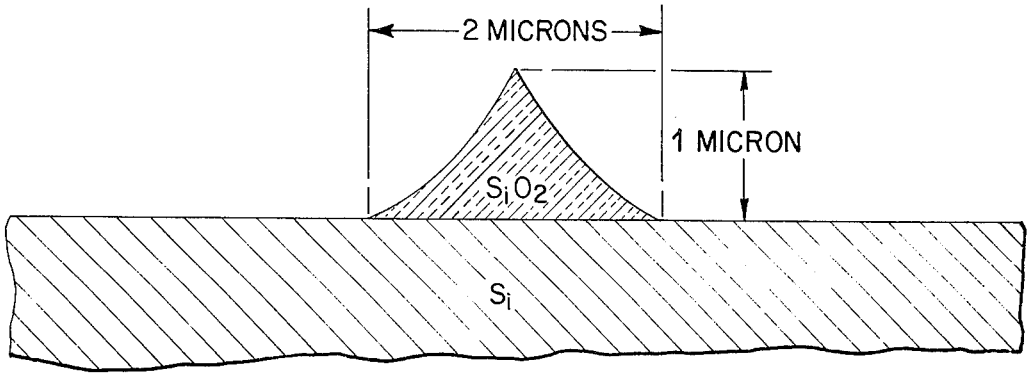
Figure 2E:
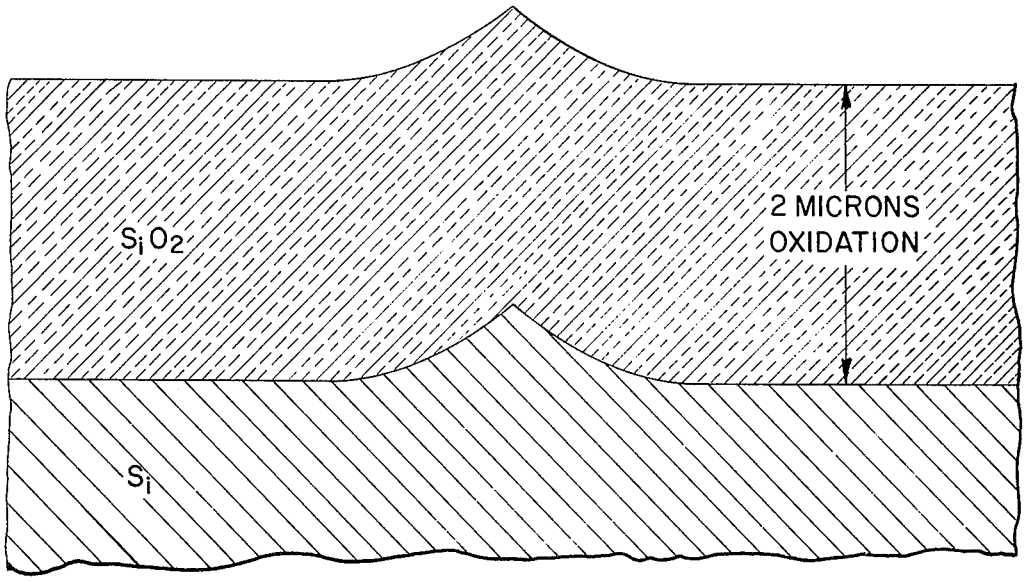

In FIG. 2D subsequent etching of a one micron thick $SiO_2$ layer starting with a $2\mu$ diameter photoresist dot has produced a pointed $SiO_2$ mask $2\mu$ in diameter at its base. This is typical of the etch behavior in an isotropic etch such as buffered hydrofluoric acid commonly used for the delineation of oxide patterns in integrated circuit fabrication. The resist has been undercut by about the same amount as the thickness of the etched layer. FIG. 2E demonstates how a subsequent $2\mu$ oxidation actually has effected the geometry of the Si and the $SiO_2$ and their relative position. A point has been created in the Si, though quite blunted, the $SiO_2$ layer is now about $2\mu$ above the Si point, but the slope on the sides of the original $SiO_2$ dot make it impossible to deposit a metal layer on the $SiO_2$ surface leaving an open area as previously described to etch out the $SiO_2$ in the area of the Si point.

Figure 3A:
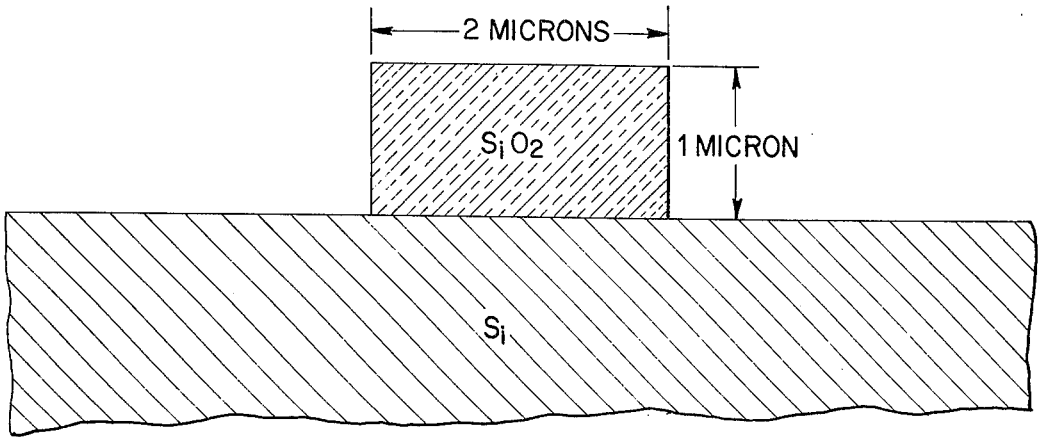
FIGS. 3A–3D are illustrative of a preferred form of microminiature electron source fabrication according to the invention.
Figure 3B:
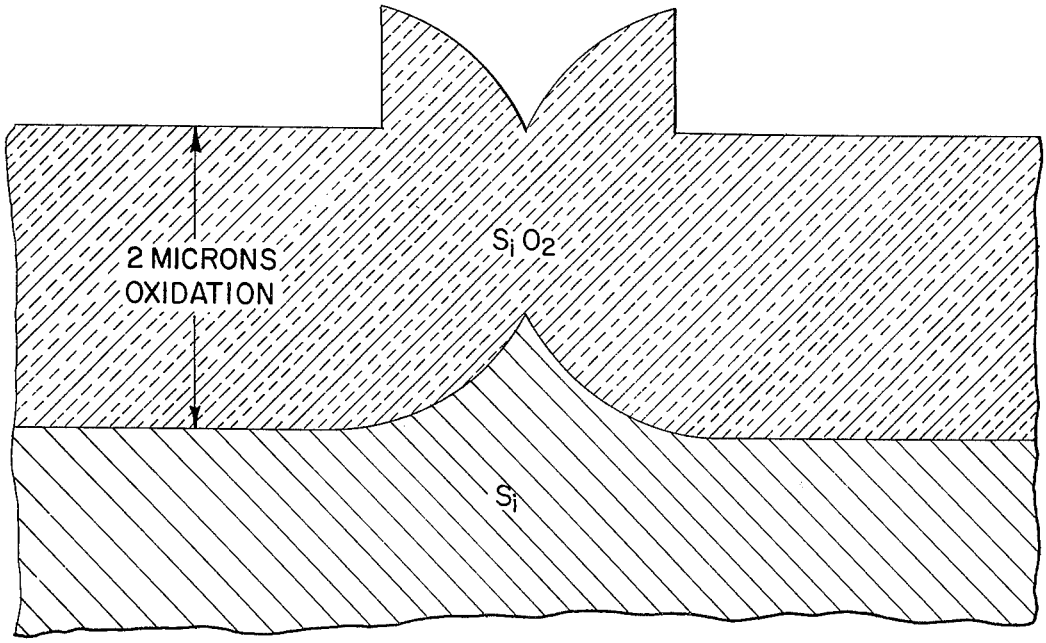

In FIGS. 3A–3D, the case is presented for what is expected if absolutely straight sides could be achieved in the etching of the $SiO_2$ dots. FIG. 3A depicts this situation after etching the $SiO_2$ dots and before oxidation point formation. The dimension of the dots are $1\mu$ thick and $2\mu$ in diameter. FIG. 3B depicts the resulting geometry after a $2\mu$ oxidation of the silicon. A point has been developed in the Si and the oxide layer is $\sim 1\mu$ above this point. The original oxide dot has developed a depression in the center such that evaporation of a metal such as Cr at oblique incidence will cover the main surface of the oxide but not the depression in the dot (see FIG. 3C). Subsequent immersion of the sample is a selective etch for $SiO_2$ (as opposed to Cr) will result in the self-aligned anode structure in FIG. 3D.

Figure 3C:
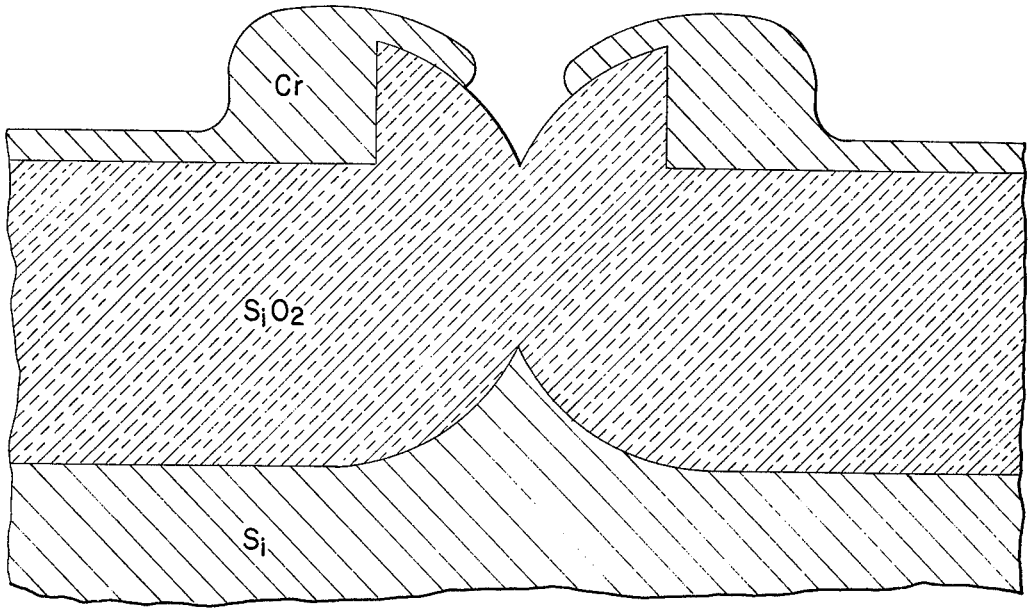
Figure 3D:
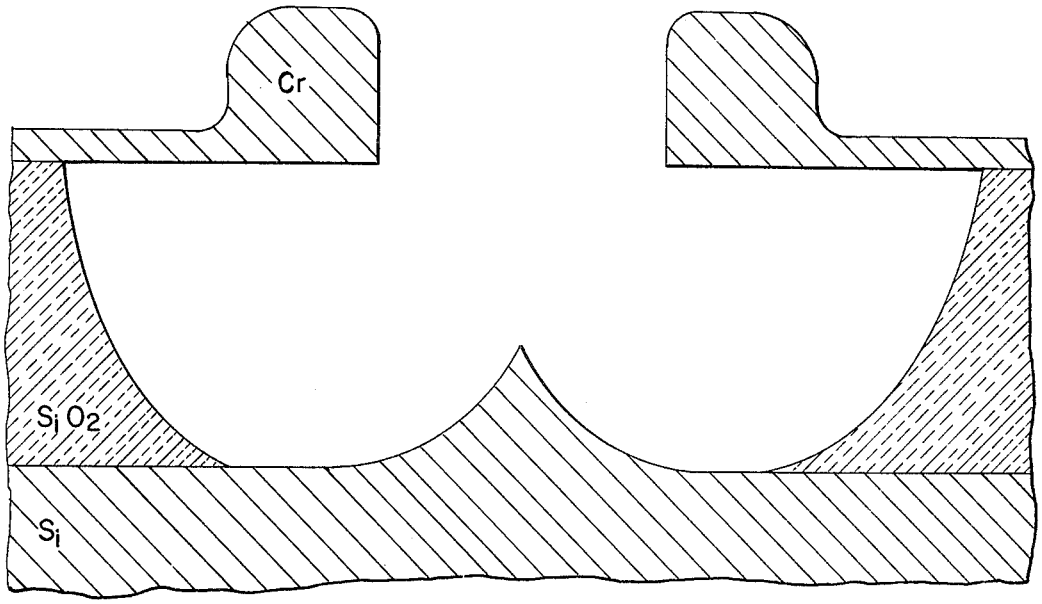

It should be noted that the thin layer of chromium which is shown on top of the $SiO_2$ dot in FIG. 3C will tend to break off and/or collapse when the $SiO_2$ is removed. A cleaner edge may at times be desirable. This can be accomplished by etching the chromium until the top of the $SiO_2$ is free of chromium. A thick anode ring of chromium is left surrounding the $SiO_2$ dot. Additional metallization to make electrical connection to these anode rings can be supplied by conventional photoresist techniques.

After having considered the above methods of oxidative point formation, an alternative method is depicted in FIGS. 4A–4C. In FIG. 4A the oxide dot formation exhibits a profile which can be achieved in one of two ways: (1) by starting with a photoresist dot of $\sim 3\mu$ diameter and overetching in a conventional aquious system; or (2) through carefully controlled sputter etching as described in Davidse, P. D., Journal of the Electrochemical Society 116, 100 (1969).

FIGS. 4B and 4C show the resulting geometrics after a $1\mu$ and a $2\mu$ oxidation. It is clear that ater a $2\mu$ oxidation the Si point is formed and the oxide depression is sufficient to allow the formation of the self-centered anode as previously discussed. A favorable geometry for the operation of these cathodes exists when the level of the anode is above the tip of the cathode by the order of a micron. As is apparent from FIG. 4C, this structure exists for a $2\mu$ oxidation—in this case, the distance between the oxide level and the silicon tip would be about $1\frac{1}{2}\mu$. It is apparent that the size of the initial oxide dot and the thickness of the subsequent point forming oxidation can be adjusted to achieve optimum distances between the resulting silicon point and the metal layer on top of the silicon dioxide.

Figure 5A:
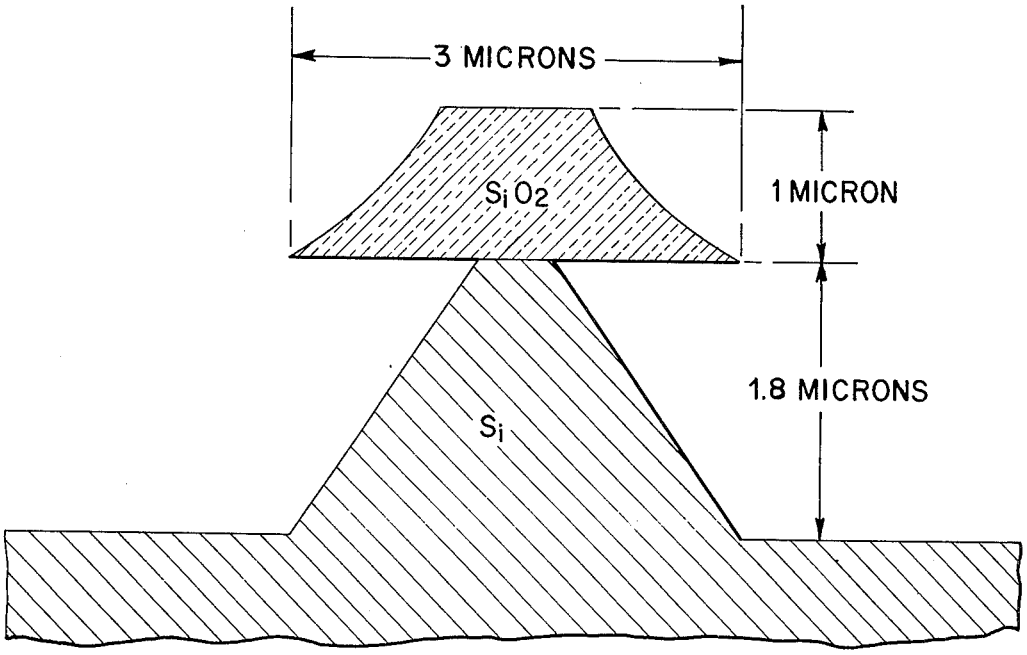
FIGS. 5A–5C illustrate still a different processing technique for producing field emission cathode sites in accordance with the invention.

In addition to the above techniques, an altlernative method has been found to achieve the oxidative point formation which involves the etching of the silicon with a selective etch (i.e., selective with respect to its ability to etch silicon and not $SiO_2$) after the formation of the oxide dot. An etch such as a pyrocatechol solution of a 50 mole % hydrazine — $H_2O$ solution will preferentially attack the (100) planes of silicon. Thus, if one uses (100) oriented silicon the etch proceeds to attack at a rapid rate until (111) planes are encountered and tends to produce a pyramidal point whose sides make an angle of about 35° to the vertical. FIG. 5A depicts the geometry resulting from an initial $3\mu$ photo resist mask, subsequent etching of a $1\mu$ thick $SiO_2$ film with typical undercutting, and finally, exposure of this structure to one of the above-mentioned etchants for sufficient time to almost but not completely undercut the $SiO_2$ mask. Point formation can be accomplished by continuing the etching until the $SiO_2$ mask is completely undercut and drops off. However, if one desires to form an array of points, the time in which one point is finished is not necessarily the same time which a neighboring point or other points in the array is finished, without absolutely stringent control on such things as the diameters of the original photoresist dots and all the subsequent etch rates which, in practice, is impossible to achieve. This means that a point which is formed early in the reaction will be attacked by the etchant after the mask drops off while the sample is continuing to be etched in order to form points on all of the members of the array. Therefore, it is preferable after the stage shown in FIG. 5A, to complete point formation of the array by oxidation.

Figure 5B:
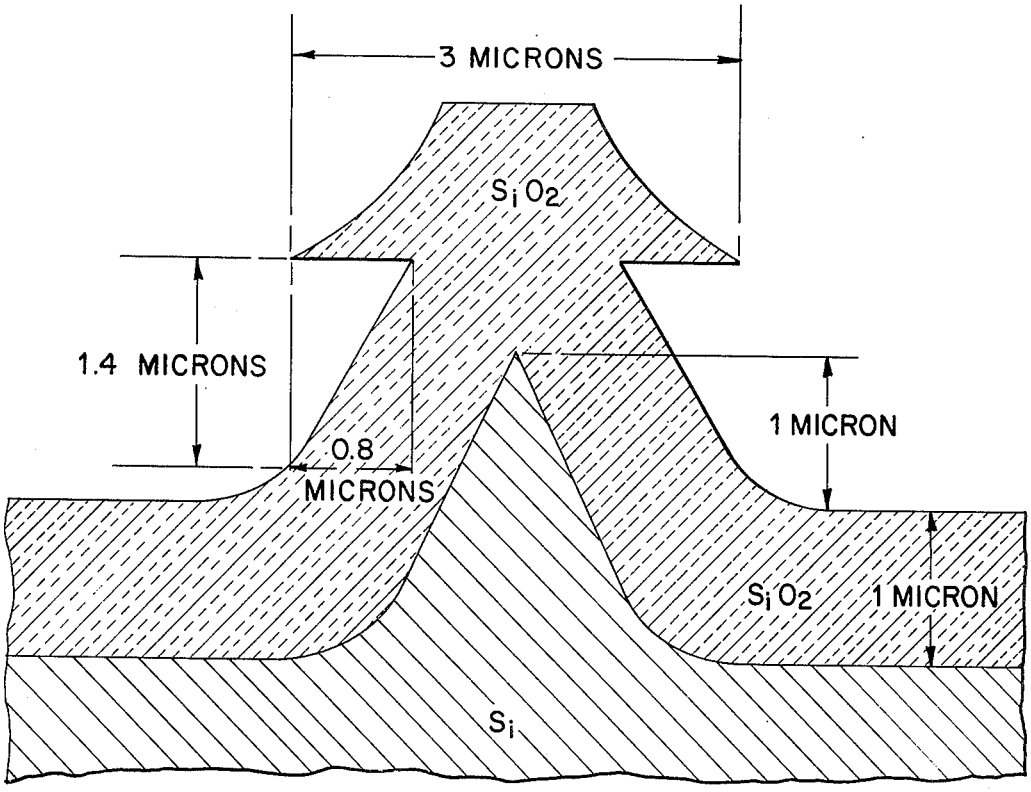

This oxidative point formation at this stage results in a structure in FIG. 5B after a $1\mu$ oxidation. It is apparent that all members of an array will have points formed without duiling since their masks will not drop off during the oxidation. FIG. 5B, however, indicates a favorable geometry for the evaporation of a metal film at normal incidence, allowing a window in the metal coverage under the overhanging edge of the original oxide mask. Through this window the $SiO_2$ can be etched away in the vicinity of the silicon tip exposing the tip and leaving a self-aligned anode structure. However, it should be noted that after a $1\mu$ oxidation the level of this $SiO_2$ is below that of the Si tip which is an undesirable geometry for the anode in an emitter structure.

Figure 5C:
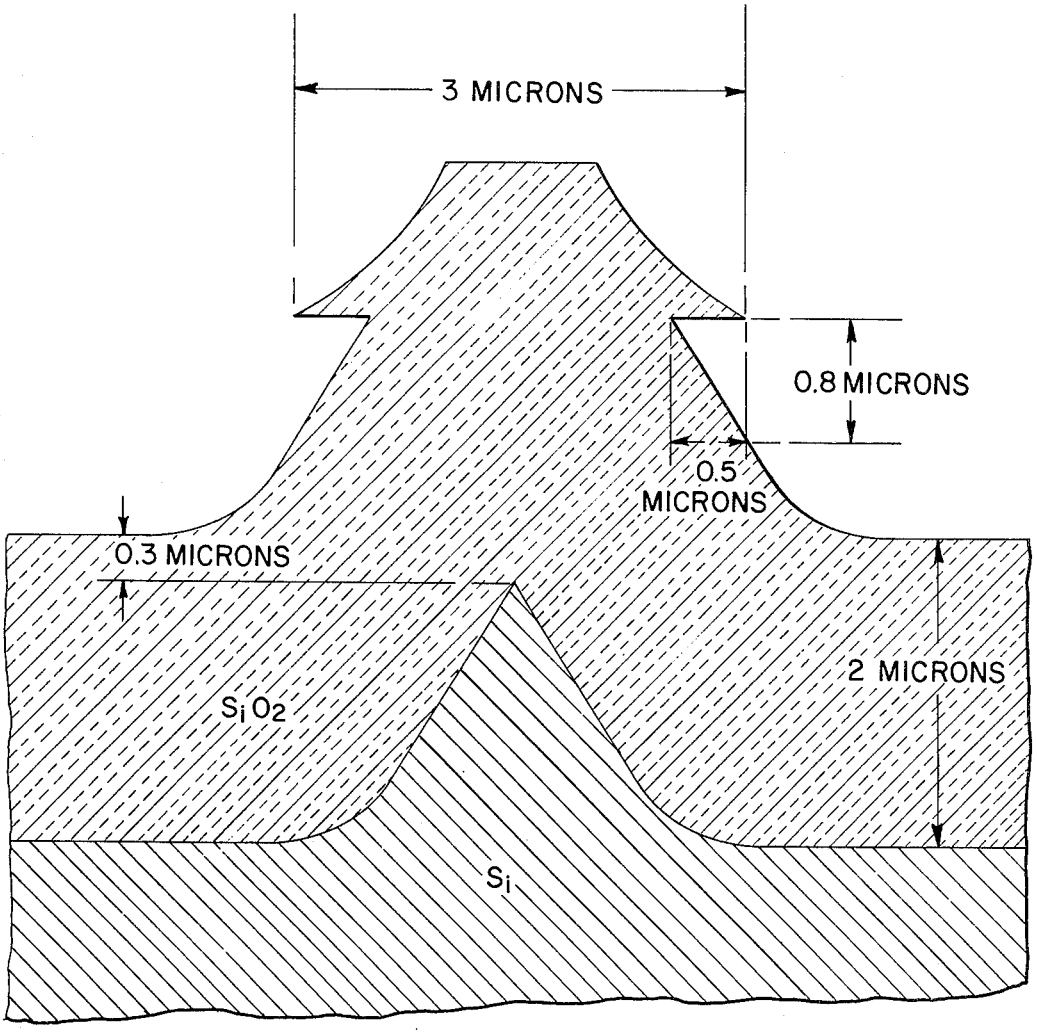

FIG. 5C depicts the geometrics resulting from a $2\mu$ oxidation of the structure in FIG. 5A. It is apparent that the oxide level is now $0.3\mu$ above the Si point. This is a more favorable geometry while preserving the overhang in the $SiO_2$ layer so that normal incidence evaporation may be used for anode formation. It is apparent that the initial size and shape of the oxide masks can be varied to achieve optimum geometry. Certain limitations do exist, however, on the thickness of subsequent oxidation ($2–3\mu$ appear to be the upper practical limits) which allow the purely oxidative point formation to produce larger distances between the self-aligned anode and the cathode tip.

FIG. 6 is a perspective view of a planar, single crystal P-type silicon wafer having formed therein (by suitable, known doping pretreatment) a series of elongated, parallel extending, opposite N-type conductivity regions with each N-type conductivity strip having a width of approximately 10 microns and a depth of approximately 3 microns. The spacing between the strips is arbitrary and can be adjusted to accommodate a desired number of field-emission cathode sites to be formed on a given size silicon wafer substrate. Processing of the substrate to provide the P-type and N-type conductivity regions may be by any well-known semiconductor processing techniques such as a diffusion and/or epitaxial growth as described in the above-reference Microelectronics textbook and the references cited therein. The particular dimensions illustrated and cited with respect to FIG. 6 are merely exemplary as stated above, and if desired the P-type and N-type regions, of course, can be reversed through the use of a suitable starting substrate and appropriate dopants.

Utilizing the preprocessed substrate of FIG. 6, and thereafter processing the structure in the manner described above with relation to any of FIGS. 1–5, a resulting composite, microminiature field emission electron source having a plurality of field emission sites similar to that illustrated in cross-section in FIG. 7 can be obtained. The field emission electron source shown in FIG. 7 would function in an identical manner to that previously described. Additionally, it should be noted that between any two N-type strip regions, there is a reversed PN diode. Hence, all of the emitters produced along a given N-type strip are electrically isolated from those produced along an adjacent N-type strip.

FIG. 8 is a partial perspective view of a further refinement to the field emission source described whereby electric isolation and selective actuation of any given field emission site formed on the surface of a microminiature electron source, readily can be obtained. In FIG. 8 it will be noted that in addition to the elongated, parallel extending, opposite conductivity N-type region strips formed in the surface of the P-type silicon semiconductor substrate, the overlying conductive layer of chromium likewise is formed (through suitable masking techniques0 in the nature of a plurality of separate, parallel, elongated conductive strips extending tranversely to and across the parallel extending, elongated opposite N-type conductivity region strips. The intersections of the transversely extending metal strips define regularly arrayed, cathode emission sites in the manner of a cross bar connector. By selective application of appropriate polarity switching potentials to a selected one of the elongated opposite N-type conductivity region strips and to a selected one of the transversely extending conductive layer strips, any desired one of the field emission cathode sites selectively can be actuated and will be electrically isolated from the other field-emission sites through the PN diode regions.

From the foregoing description it will be appreciated that the present invention provides a new and improved microminiature field emission cathode structure for use in forming improved microminiature electron sources having integrally formed, centrally oriented, single crystal semiconductor, microstructure field emission cathode tips and integrally packaged accelerating micro-anodes. The improved microstructure electron sources are provided by appropriately adapting known microminiature semiconductor integrated circuit manufacturing techniques to the construction of the electron sources. By appropriate processing of the semiconductor substrate with which the sources are fabricated, each field emission cathode site formed on the surface of the semiconductor substrate can be electrically isolated from others of a multiplicity of such sites and selectively actuated.

Having described several embodiments of new and improved microminiature field emission cathodes and electron sources utilizing the improved methods of manufacturing such sources herein described, it is believed obvious that other modifications and variations of the invention will be suggested to those skilled in the art in the light of the above teachings. It is, therefore, to be understood that changes may be made in the paticular embodiments of the invention described which are within the full intended scope of the invention as defined by the appended claims.

What is claimed is:

1. A new and improved field emission electron source comprising a semiconductor substrate, an insulating layer formed over a surface of the semiconductor substrate, an overlying conductive layer formed over the insulating layer and at least one field emission cathode site comprised by an opening formed in the insulating layer and overlying conductive layer exposing a part of the underlying semiconductor substrate with the central region of the exposed underlying semiconductor forming a raised emitting tip of semiconductor integral with the underlying semiconductor substrate.

2. A field emission electron source according to claim 1 wherein the semiconductor substrate is from the class of materials consisting essentially of silicon and germanium, the insulating layer is formed by oxidation of the semiconductor substrate, and the overlying conductive layer is from the class of materials consisting essentially of chromium and molybdenum.

3. A field emission electron source according to claim 1 whereinthe raised emitting tip of semiconductor is formed by selective oxidation of the surface of the underlying semiconductor substrate and subsequent selective etching away of selectively oxidized regions surrounding a centrally disposed unoxidized tip of underlying semiconductor substrate not subjected to oxidation.

4. A field emission electron source according to claim 3 wherein the semiconductor substrate is from the class of materials consisting essentially of silicon and germanium, the insulating layer is formed by oxidation of the semiconductor substrate, and the overlying conductive layer is from the class of materials consisting essentially of chromium and molybdenum.

5. A field emission electron source according to claim 3 wherein there are a plurality of field emission cathode sites formed by a plurality of openings through the overlying conductive and insulating layers with each opening having an integral centrally disposed raised emitting tip formed on the surface of the underlying semiconductor substrate and integral therewith.

6. A field emission electron source according to claim 5 wherein the plurality of openings are regularly arrayed and each field emission site is selectively actuable.

7. A field emission electron source according to claim 6 wherein the immediate region of the semiconductor substrate surrounding and including the raised field emitting tip is appropriately doped to form an opposite conductivity-type semiconductor region from that of the remainder of the underlying semiconductor substrate whereby the plurality of field emission cathode sites can be electrically isolated one site from the other.

8. A field emission electron source according to claim 7 wherein the underlying semiconductor substrate is a planar element and the opposite type conductivity regions in which the emitters are located comprise a plurality of parallel elongated strips and the overlying conductive layer is comprised by a plurality of parallel elongated strips extending transversely to and intersecting the opposite type conductivity strip regions with the intersections defining the regularly arrayed cathode emission sites in the manner of a cross bar connector.

9. A field emission electron source according to claim 8 wherein selective application of an appropriate polarity switching potential to a selected one of the elongated opposite type conductivity region strips and to a selected one of the transversely extending conductive layer strips selectively actuates a desired one of the field emitter sites.

10. A field emission electron source according to claim 9 wherein the semiconductor substrate is from the class of materials consisting essentially of silicon and germanium, the insulating layer is formed by oxidation of the semiconductor substrate, and the overlying conductive layer is from the class of materials consisting essentially of chromium and molybdenum.

11. A field emission electron source according to claim 1 wherein the raised emitting tip of semiconductor is formed by first selectively etching the surface of the semiconductor except in the areas where it is desired to form a raised emitting tip with the selective etching being carried out to an extent sufficient to undercut such areas, oxidation of the surface of the underlying semiconductor substrate to an extent necessary to form a finely pointed tip of non-oxidized semiconductor and subsequent selective etching away of selectively oxidized regions surrounding a centrally disposed non-oxidized pointed tip of underlying semiconductor substrate not subjected to oxidation.

12. A field emission electron source according to claim 11 wherein the semiconductor substrate is from the class of materials consisting essentially of silicon and germanium, the insulating layer is formed by oxidation of the semiconductor substrate, and the overlying conductive layer is from the class of materials consisting essentially of chromium and molybdenum and is spaced above and beyond the tip of unoxidized semiconductor substrate measured with respect to the top surface of the substrate.

13. A field emission electron source according to claim 11 wherein there are a plurality of field emission cathode sites formed by a plurality of openings through the overlying conductive and insulating layers with each opening having an integral centrally disposed raised emitting tip formed on the surface of the underlying semiconductor substrate and integral therewith.

14. A field emission electron source according to claim 13 wherein the plurality of openings are regularly arrayed and each field emission site is selectively actuable.

15. A field emission electron source according to claim 14 wherein the immediate region of the semiconductor substrate surrounding and including the raised field emitting tip is appropriately doped to form an opposite conductivity-type semiconductor region from that of the remainder of the underlying semiconductor substrate whereby the plurality of field emission cathode sites can be electrically isolated one site from the other.

16. A field emission electron source according to claim 15 wherein the underlying semiconductor substrate is a planar element and the opposite type conductivity regions in which the emitters are located comprise a plurality of parallel elongated strips and the overlying conductive layer is comprised by a plurality of parallel elongated strips extending transversely to and intersecting the opposite type conductivity strip regions with the intersections defining the regularly arrayed cathode emission sites in the manner of a cross bar connector.

17. A field emission electron source according to claim 16 wherein selective application of an appropriate polarity switching potential to a selected one of the elongated opposite type conductivity region strips and to a selected one of the transversely extending conductive layer strips selectively actuates a desired one of the field emitter sites.

18. A field emission electron source according to claim 17 wherein the semiconductor substrate is from the class of materials consisting essentially of silicon and germanium, the insulating layer is formed by oxidation of the semiconductor substrate, and the overlying conductive layer is from the class of materials consisting essentially of chromium and molybdenum and is spaced above and beyond the tip of unoxidized semiconductor substrate measured with respect to the top surface of the substrate.

* * * * *

UNITED STATES PATENT OFFICE

CERTIFICATE OF CORRECTION

Patent No. 3,970,887 Dated July 20, 1976

Inventor(s) Donald O. Smith et al.

It is certified that error appears in the above-identified patent and that said Letters Patent are hereby corrected as shown below:

Co-inventor's name should read -- Michael Frongillo --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*